US005267743A

United States Patent [19]

Smisek

[11] Patent Number: 5,267,743

[45] Date of Patent: Dec. 7, 1993

[54] LOW PROFILE SKATEBOARD

[76] Inventor: Brandon T. Smisek, 223 Flower St., Costa Mesa, Calif. 92627

[21] Appl. No.: 794,406

[22] Filed: Nov. 19, 1991

[51] Int. Cl.[5] ..... A63C 17/01

[52] U.S. Cl. ..... 280/87.042; 280/79.11; 280/87.041

[58] Field of Search ..... 280/87.042, 87.041, 280/87.03, 87.02, 87.01, 79.11, 32.6

[56] References Cited

U.S. PATENT DOCUMENTS

| | | | |
|---|---|---|---|
| 291,000 | 12/1883 | Peeler . | |
| 3,843,146 | 10/1974 | Hiraki | 280/11.2 |
| 4,061,350 | 12/1977 | Schmidt, Jr. et al. | 280/87.04 A |
| 4,151,892 | 5/1979 | Francken | 180/77 |
| 4,168,842 | 9/1979 | Kimmell et al. | 280/11.28 |
| 4,180,278 | 12/1979 | Gottlieb | 280/87.04 A |
| 4,234,204 | 11/1980 | Tibbals | 280/87.04 A |
| 5,022,670 | 6/1991 | Cote et al. | 280/32.6 |
| 5,067,058 | 11/1991 | Standley | 280/87.042 |

FOREIGN PATENT DOCUMENTS

| | | | |
|---|---|---|---|
| 892715 | 10/1953 | Fed. Rep. of Germany | 280/79.11 |
| 2416027 | 10/1979 | France | 280/87.042 |
| 8701297 | 3/1987 | World Int. Prop. O. | 280/87.042 |

*Primary Examiner*—Eric D. Culbreth
*Attorney, Agent, or Firm*—Graham & James

[57] ABSTRACT

A skateboard employs a hollow elongated board having openings, formed in the underside of the board, adapted to receive standard skateboard wheels. Since the wheels are recessed in the board, the skateboard si&:s very low to the ground, giving the board a low profile and low center of gravity. The skateboard further employs wheel ramps on opposite sides of each wheel to provide a smooth under surface to aid in the negotiation of large obstacles such as curbs, stairs, etc. and to allow the skateboard to glide over smaller obstacles.

17 Claims, 5 Drawing Sheets

FIG. 2
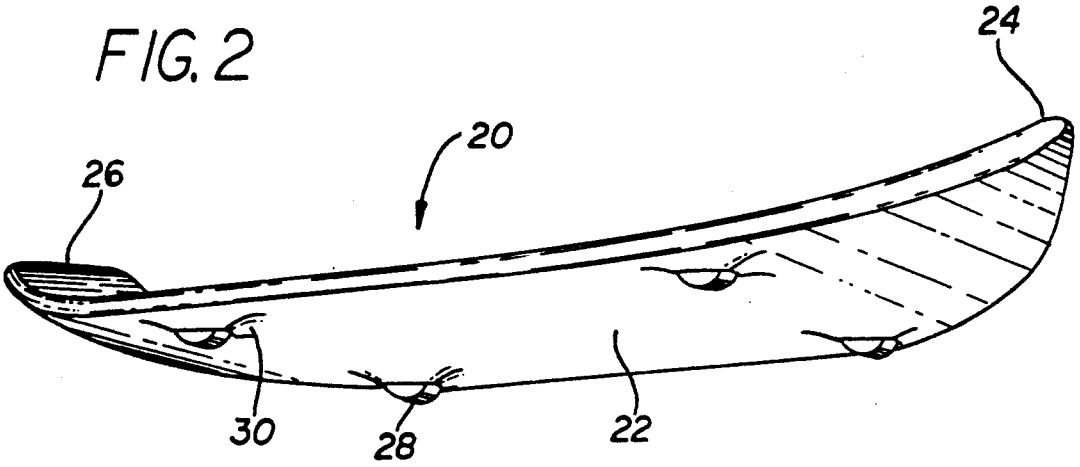
FIG. 3
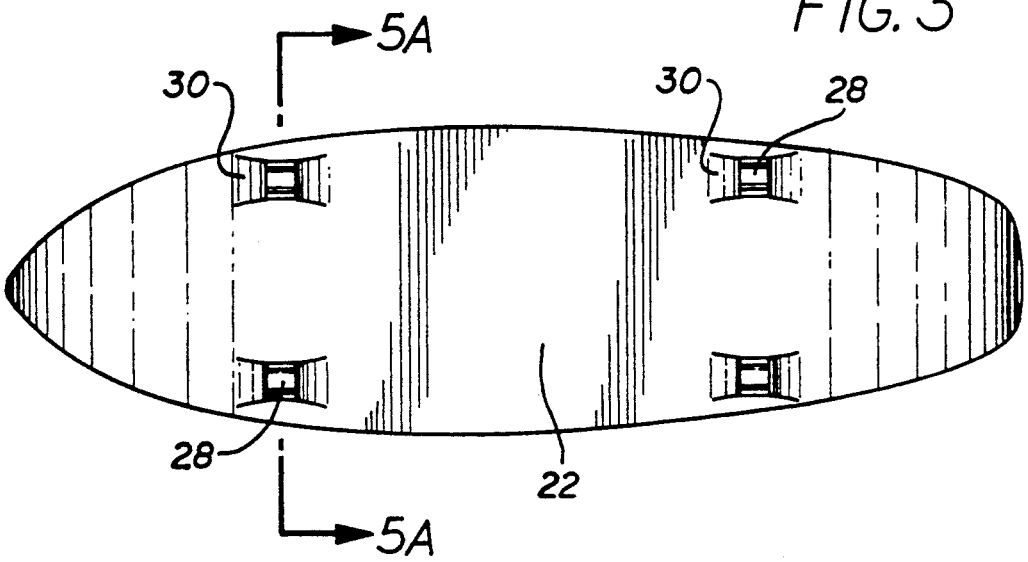
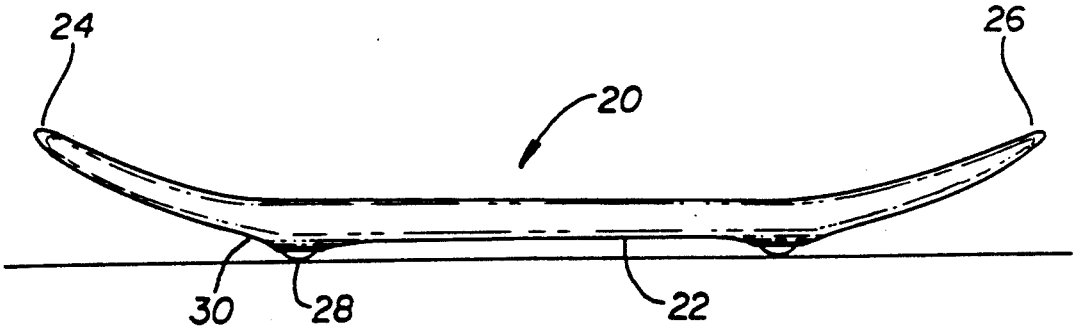
FIG. 4

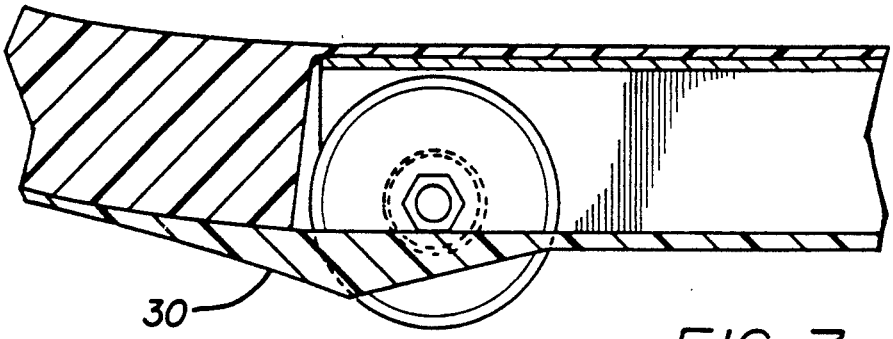
FIG. 7
FIG. 8A
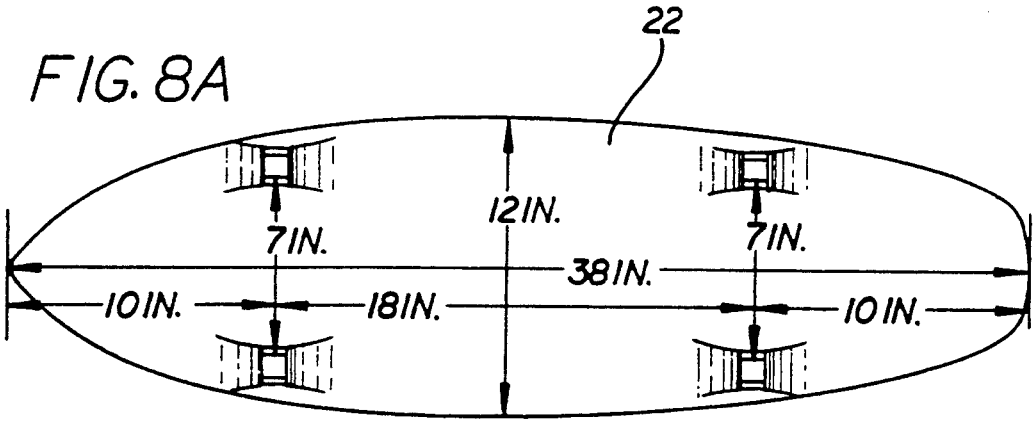
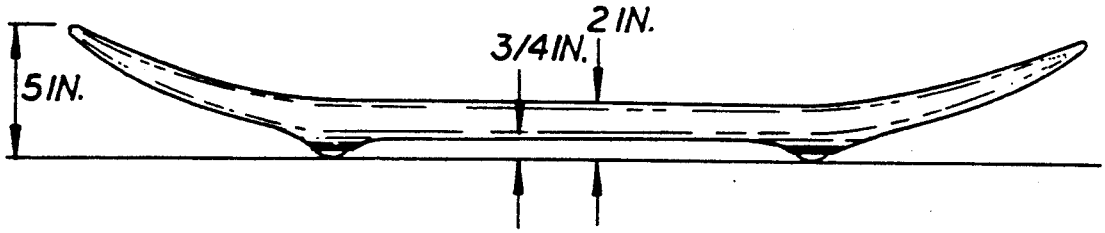
FIG. 8B

LOW PROFILE SKATEBOARD

BACKGROUND OF THE INVENTION

1. Field of the Invention

The present invention relates generally to the field of unmotorized wheeled recreational products. More specifically, the present invention relates to skateboards.

2. Description of Related Information and Prior Art

Skateboards have attained considerable popularity in recent years, and are ridden competitively as well as for recreational use. Although skateboards have been modified in various ways with respect to shape, size and color, their basic construction has remained substantially unchanged.

FIGS. 1(A) and 1(B) illustrate a bottom view and a side view, respectively, of a conventional skateboard. As illustrated in FIGS. 1(A) and 1(B), a conventional skateboard 10 typically comprises a rigid board 12, supported by two sets of wheels 14. The wheels 14 are mounted to "trucks" 16 which are bolted to the underside of the board. The trucks 16 are designed to enable the rider to steer the skateboard by leaning to one side or the other. The trucks each include a flexible axle mount (not shown). As the rider leans to one side, the axles in the trucks 16 are deflected relative to the board 12, thereby causing the skateboard to turn. By adjusting the trucks and axle mounts, the ease of steering may be varied from very rigid to very flexible.

Riser pads 18 are often installed between the trucks 16 and the board 12. This is done to increase the distance between the bottom of the skateboard and the top of the wheels to prevent the wheels from rubbing on the edges of the board during sharp turn maneuvers. Use of riser pads 18 can elevate the center of gravity and the surface of the board from approximately 4½ inches above the ground to 6 inches above the ground. This high perch riding position is unstable, however, and becomes even more precarious if the trucks are adjusted loosely for maximum steering maneuverability.

In particular, the elevated height of the skateboard from the ground, caused by use of conventional trucks 16 and riser pads 18, as well as the flexibility in the trucks themselves, often result in the skateboard wobbling at higher speeds. This wobbling action causes the entire board 12 to oscillate uncontrollably and novice riders will often crash in response to such wobbling. Furthermore, the high perch position and the flexibility of the trucks present an unpredictable and insecure riding position for the novice.

A further disadvantage of conventional skateboard design is the difficulty in overcoming obstacles, both large and small. When large obstacles are encountered, the rider must make sure both front and rear wheels avoid getting caught up while negotiating the obstacle. Although, experienced riders are able to lift the wheels over such obstacles by use of a jumping maneuver, such a maneuver is very difficult to master. As a result most novice riders must stop and carry the skateboard over large obstacles. When small obstacles are encountered, even at low speeds, the wheels tend to lock up as the obstacle is encountered, thereby abruptly stopping the progress of the skateboard and often throwing the rider from the skateboard.

Accordingly, it will be appreciated that conventional skateboards suffer from a lack of stability and safety, especially for novice riders, and are difficult to negotiate over obstacles, large and small.

SUMMARY OF THE INVENTION

The present invention provides a skateboard having increased stability over conventional skateboards. The present invention further provides a skateboard having the ability to glide over small obstacles and smoothly surmount larger obstacles with minimal rider skill.

In a preferred embodiment, the present invention provides a skateboard having a rigid platform with an upper support surface for the rider and a lower surface having two channels. Wheels are recessed in the channels and extend into the interior of the platform. Because the wheels are recessed, the skateboard may be configured lower to the ground than a conventional skateboard; approximately ¾" above the ground in a preferred embodiment. This results in a low profile and a low center of gravity. Such a low center of gravity skateboard provides the rider with a safer, more stable, riding position than a conventional skateboard. Also, the board portion of the skateboard of the present invention is preferably wider than a conventional skateboard; in a preferred embodiment, approximately 12" wide. The size of the skateboard, combined with the low center of gravity, substantially eliminates high speed oscillation and "wheel wobble" which commonly occurs with conventional skateboards. Additionally, upwardly curving front and rear ends are preferably provided.

The skateboard of the present invention is also preferably provided with wheel ramps on the underside of the skateboard, on opposite sides of each wheel. Such ramps lessen the amount of exposed wheel area, and, in combination with the recessed wheels, provide a substantially smooth under surface for the skateboard. This enables the rider to surmount major obstacles such as sidewalk curbs, stairs, etc. with ease. For example, the skateboard of the present invention may negotiate stairs in a down direction by simply gliding down the stairs, which maneuver is impossible with a conventional skateboard. In addition, the recessed wheel design, combined with the wheel ramps, makes it much easier to negotiate small obstacles as only a small portion of the wheels are exposed to such obstacles. For example, the bottom of the skateboard can skim over rough and irregular terrain such as grass, sand, gravel, puddles of water, packed dirt and various other debris. The skateboard of the present invention may preferably employ a removable skid pad bottom surface, which includes the wheel ramps and is adapted to be easily replaceable. The skid pad may be composed of a hard plastic which slides easily over objects and which preserves the underside of the board.

The recessed wheel design of the skateboard of the present invention dispenses with conventional skateboard trucks, and instead employs a fixed axle design. To turn the skateboard of the present invention, the rider simply presses down on the rear portion of the skateboard with one foot, while simultaneously, the rider eases the pressure from the front foot. Then, the rider turns his body in the desired direction, thereby changing the path of the skateboard. Such new riding method is very similar to that of riding a surfboard. Thus, riders familiar with surfing techniques may readily adapt their skills to riding the skateboard of the present invention. Conversely, riders of the skateboard of the present invention may gain familiarity with techniques which may be applied in surfing.

Accordingly, it will be appreciated that the skateboard of the present invention provides a completely unique riding experience from a conventional skateboard, while improving stability and safely for both novice and experienced riders.

BRIEF DESCRIPTION OF THE DRAWINGS

FIG. 2 is a perspective view of the skateboard of the present invention.

FIG. 3 is a plan view of the underside of the skateboard of the present invention.

FIG. 4 is a side view of the side of the skateboard of the present invention.

FIG. 7 is a cut away view of a side of the skateboard, illustrating an alternate embodiment of the wheel ramps.

FIGS. 8(A) and 8(B) are bottom and side views, respectively, of the skateboard illustrating preferred dimensions of the skateboard.

DETAILED DESCRIPTION OF THE INVENTION

Figure 1A:
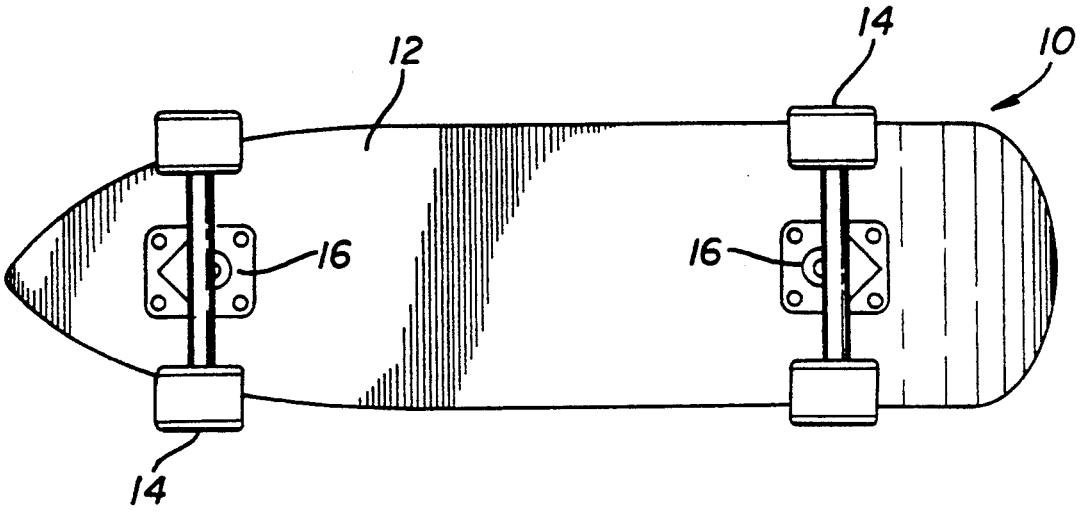
FIG. 1A PRIOR ART
FIGS. 1(A) and 1(B) illustrate a plan view and a side view of the underside of a prior art skateboard, respectively.
Figure 1B:
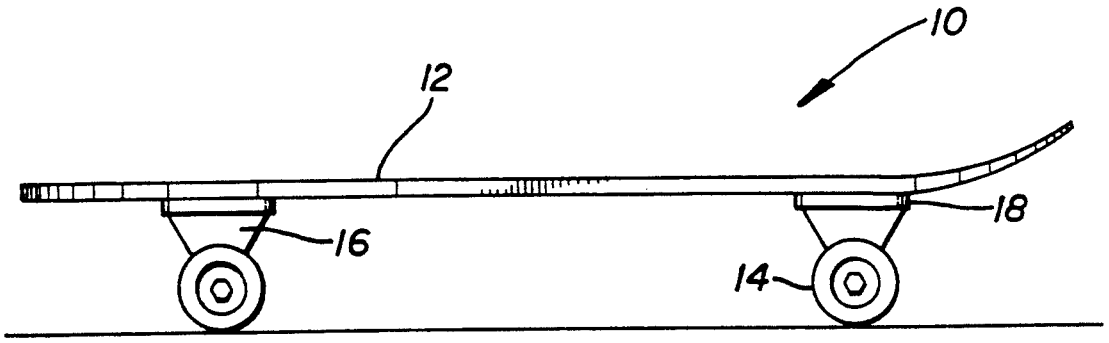
FIG. 1B PRIOR ART

Referring to FIG. 2, a perspective view of a skateboard 20 made in accordance with a preferred embodiment of the present invention is illustrated. As also illustrated in FIGS. 3 and 4, the skateboard of the present invention includes a board 22, having a front end 24 and a rear end 26. Preferably, the front end of the board 24 is curved in an upward direction in a manner similar to that of a conventional skateboard. The rear portion of the board is also curved upward to facilitate the novel steering technique required for the skateboard of the present invention. The board 22 is supported by wheels 28 which are disposed in recessed channels 32*a,b*, integrally formed in the underside of the board 22. This recessed wheel design conceals the wheels from view, giving the skateboard 20 a low to the ground appearance, appearing to hover in the air just above the ground. In addition, since the board 22 is low to the ground, the center of gravity thereof is lowered, thereby creating a safer riding vehicle.

Figure 5A:
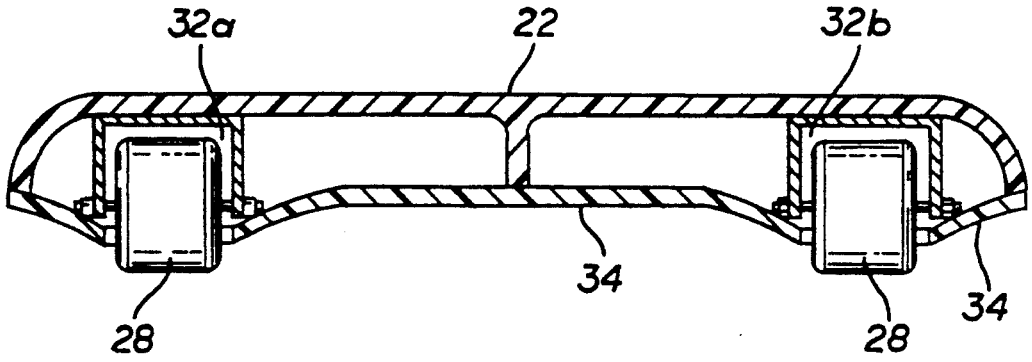
FIG. 5(A) is a cross-sectional view, taken along line 5—5 of FIG. 3, showing the wheels recessed in the channels.
Figure 5B:
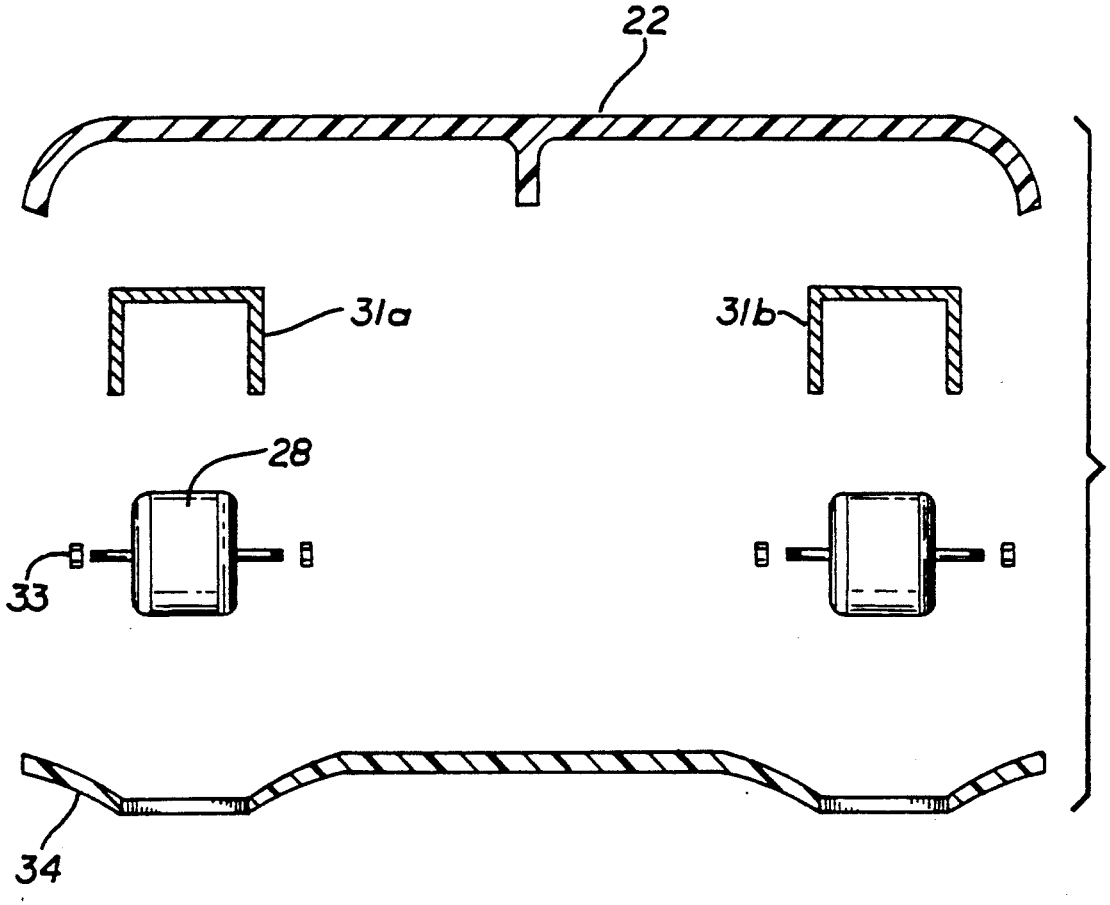
FIG. 5(B) is an exploded view, showing a preferred sectional construction of the skateboard.

As most clearly illustrated in the sectional view of FIG. 5(A) and the exploded view of FIG. 5(B), the board 22 preferably has a hollow structure to reduce weight, and has two channel supports 31*a,b* for added strength. The board 22 may be formed from any suitable material and is preferably formed from a hard, strong plastic, such as polypropylene plastic. The channel supports 31*a,b* are preferably formed from extruded aluminum, e.g. approximately ⅛ inch thick, and are mounted in the underside of the board 22 in channels 32*a, b*, respectively. As illustrated, a nut and bolt assembly is provided to secure the wheels 28 and axles 33 within the recessed channels 32*a,b*. Advantageously, the skateboard 20 of the present invention utilizes standard solid axle skateboard wheels, allowing the rider to select wheels which suit his riding ability.

As further illustrated in FIGS. 5(A) and 5(B), the underside of the skateboard is a skid pad 34. Skid pad 34 is secured to the upper portion of the board 22 and covers the channels 32*a,b* and part of the exposed portion of the wheel. Skid pad 34 may be adhesively secured or have projections which match recesses in the underside of the board so as to allow the skid pad to snap into engagement with the upper portion of the board 22.

Figure 6A:
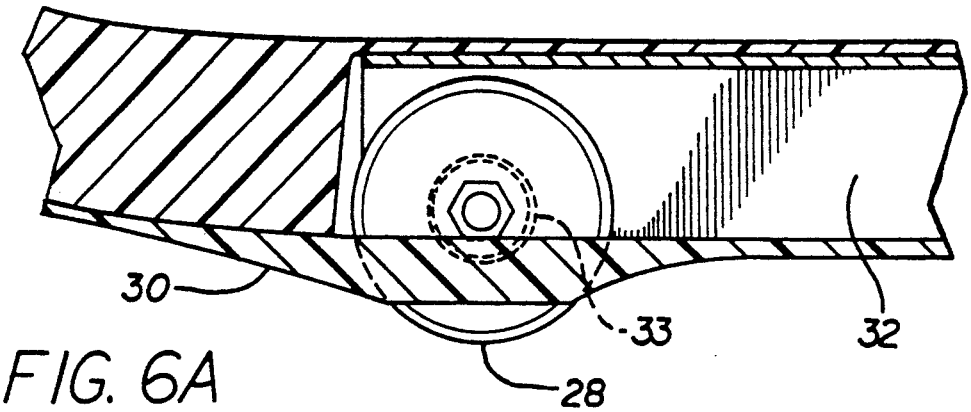
FIG. 6(A) is a cut away view of a side of the skateboard, illustrating a recessed wheel disposed therein.
Figure 6B:
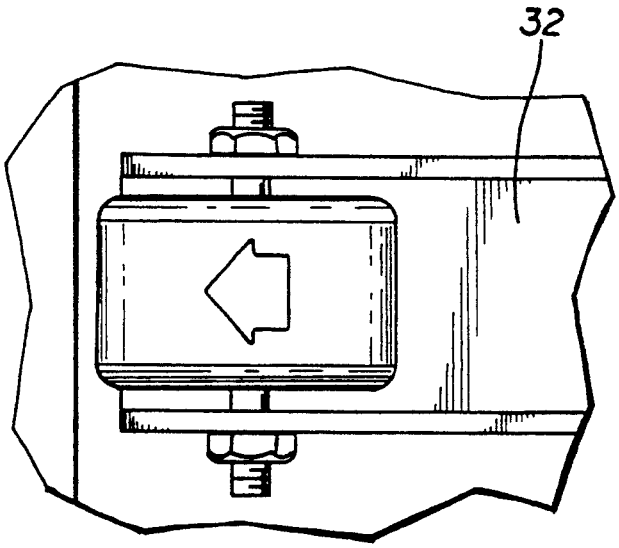
FIGS. 6(B) and 6(C) are bottom views showing a recessed wheel, with and without the skid-plate.

FIGS. 6(A) and 6(B) further illustrate the mounting arrangement of the wheels 28 within the channels 32. This unique recessed wheel design lessens the radially exposed portion of the wheel, thus eliminating the problem of the wheels encountering an obstacle at a 90° angle, which could cause the skateboard to come to an abrupt stop. As further illustrated in FIGS. 6(B) and 6(C), the skid plate 34 covers the bottom opening of the channel and conceals the majority of the wheel when viewed from below.

Figure 6C:
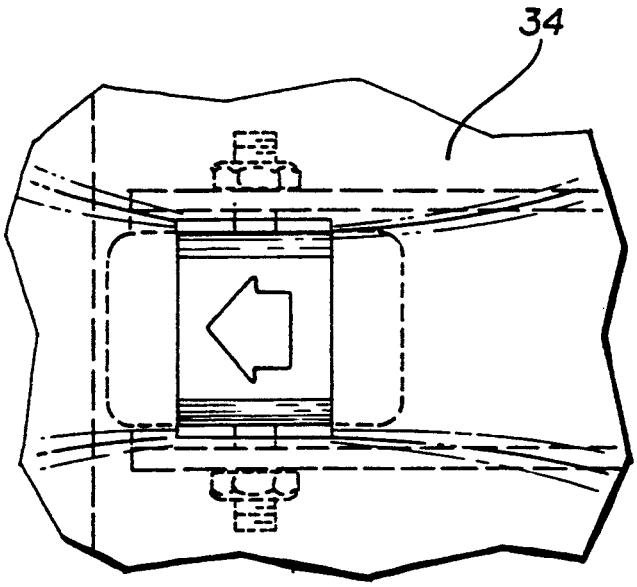

As further illustrated in FIG. 6(A) and 6(C), wheel ramps 30 formed as part of skid plate 34 may be provided in front of and behind each of the recessed wheels 28. Alternatively, ramps 30 may be only in front of the wheel as illustrated in FIG. 7. The wheel ramps 30 further lessen the exposed wheel area such that only approximately 25% or less of the wheel is exposed. Furthermore, the angle of the wheel with respect to an obstacle is reduced from 90° in a conventional skateboard to about 30° or less. The wheel ramps thus allow the rider of the skateboard 20 to aggressively approach and negotiate obstacles without the usual "Olli-Pop" technique used on conventional skateboards to jump over obstacles. In addition, the wheel ramps 30, combined with the recessed wheel design, eliminate the wheel "hang-up" problem which is prevalent in conventional skateboards.

Referring to FIGS. 8(A) and 8(B), preferred dimensions of the skateboard of the present invention are illustrated. (The channel supports 31*a,b* are preferably 1½ inches by 1¼ inches by 24 inches long.) The illustrated dimensions provide a desired low center of gravity and a relatively large upper riding surface to provide optimum riding stability and safety. It will be appreciated, however, that modifications may be made in the noted dimensions while retaining many of the desirable features of the present invention. For example, the various length and width dimensions may be increased or decreased by as much as 50% while the clearance of the bottom surface may be reduced to as little as desired in accordance with the smoothness of the riding surface. Also, it will be appreciated that the relative size of the dimensions may be modified from that illustrated without departing from the spirit or scope of the present invention.

Because the wheels 28 used in the skateboard of the present invention are preferably solid axle wheels, a new method of riding may be adopted by the rider to negotiate turns, etc. The steering of the skateboard 20 of the present invention utilizes the same technique as that used on a surfboard. The rider simply presses down on the rear portion 26 of the board 22 with one foot, while simultaneously easing pressure from the foot on the front end 24 of the board 22. Then, using the back wheels as a pivot, the rider turns his body in the desired direction, thereby changing the path of the skateboard. This technique is much different than that used to steer a conventional skateboard and gives a much more fluid appearance. Alternatively, "kick-turn" steering may be employed. This steering techniques is common in conventional skateboarding and entails tilting the board onto the back wheels and pivoting the board about the back wheels. The former "surfing" technique may preferably be employed for gentle turns and the "kick-turn" for sharp (180°-360° ) turns.

While the present exemplary embodiment has been illustrated and described, it will be recognized that this invention may be otherwise and variously be embodied without departing from the spirit and scope of the present invention.

What is claimed is:

1. A skateboard comprising:

a platform adapted to support a rider having an upper surface, a lower surface, front and rear ends spaced apart in a length direction, and a plurality of channels, recessed into the lower surface of said platform; and a plurality of wheels, mounted within said channels such that less than half of the diameter of said wheels are exposed, so as to provide the skateboard with a low center of gravity, two or more of said wheels being configured relative to one of the ends of said platform so as to provide a pivot point for upward pivoting of the front end substantially displaced from both said one of the ends and the middle of said platform in the length direction.

2. A skateboard as set out in claim 1, further comprising plural pairs of wheel ramps on said lower surface of said platform such that a pair of said wheels ramps are disposed on opposite sides of each wheel.

3. A skateboard as set out in claim 1, wherein the center of gravity is between approximately ¾ inches and 2 inches above the ground.

4. A skateboard as set out in claim 1, wherein said first and second ends curve upwardly.

5. A skateboard as set out in claim 4, wherein the upper surface of said platform has a minimum height of approximately 2 inches above the ground or less and the lower surface has a minimum height of approximately ¾ inches or less and wherein said upwardly curved ends have a height of approximately 5 inches.

6. A skateboard as set out in claim 1, wherein said platform is approximately 12 inches wide.

7. A skateboard as set out in claim 1, further comprising first, second, third and fourth axles, and wherein said wheels are four in number and a first pair of wheels are mounted on the first and second axles at a front portion of the skateboard and a second pair of wheels are mounted on the third and fourth axles at a rear portion of the skateboard.

8. A skateboard as set out in claim 7, wherein each of said four wheels is mounted in a respective channel and wherein each of said axles extends through a respective channel.

9. A skateboard as set out in claim 7, wherein the distance between said first and second pairs of wheels is approximately 18 inches.

10. A skateboard as set out in claim 7, wherein the wheels in each of said first and second pairs are spaced approximately seven inches apart.

11. A skateboard as set out in claim 1, wherein said pivot point is approximately equidistant between said end and the middle of said platform.

12. A skateboard as set out in claim 1, wherein said upper surface of said platform has a rounded partial elliptical shape at said first end.

13. A skateboard comprising:

a support member having first and second ends spaced apart in a length direction, an upper planar surface adapted to support a rider and a lower surface, said lower surface having a plurality of openings;

a plurality of wheels, spaced substantially away from said ends, each partially configured within the support member and partially extending outside of said lower surface of the support member through respective ones of said openings; and a plurality of axles mounted within said support member, each rotatably coupled to one or more said wheels;

wherein said lower surface of the support member is smoothly sloping from a first height adjacent one of said ends to a substantially lower height in front of one or more of said openings; and wherein said bottom surface smoothly slopes from the edges of said platform adjacent to the openings to the sides of said openings.

14. A skateboard as set out in claim 13, wherein less than about 30 percent of each of said wheels extends below said lower surface.

15. A skateboard as set out in claim 13, wherein the angle between the bottommost portion of each wheel and the uppermost exposed portion thereof is less than about 30 degrees.

16. A skateboard as set out in claim 13, wherein said first height is approximately 5 inches.

17. A skateboard as set out in claim 13, wherein said upper surface of said platform has a rounded partial elliptical shape at said first end.

* * * * *